United States Patent [19]

Schulz et al.

[11] 4,366,037

[45] Dec. 28, 1982

[54] METHOD OF INCREASING USEFUL LIFE EXPECTANCY OF MICROPOROUS SEPARATORS

[75] Inventors: Arthur C. Schulz, North Tonawanda; Edward H. Cook, Jr.; Krishnan Viswanathan, both of Niagara Falls, all of N.Y.

[73] Assignee: Occidental Chemical Corporation, Niagara Falls, N.Y.

[21] Appl. No.: 352,837

[22] Filed: Feb. 26, 1982

[51] Int. Cl.[3] ..... C25B 1/34; C25B 9/00; C23F 13/00

[52] U.S. Cl. ..... 204/98; 204/197; 204/252; 204/283; 204/128

[58] Field of Search ..... 204/252, 283, 196, 197, 204/263, 266, 98, 128

[56] References Cited

U.S. PATENT DOCUMENTS

| | | | |
|---|---|---|---|
| 2,944,956 | 7/1960 | Blue et al. | 204/266 |
| 3,344,053 | 9/1977 | Neipert et al. | 204/266 |
| 3,871,988 | 3/1975 | Harke et al. | 204/284 |
| 3,989,615 | 11/1976 | Kiga et al. | 204/252 |
| 4,165,271 | 4/1979 | Kadija | 204/252 |
| 4,209,368 | 1/1980 | Coker et al. | 204/283 |
| 4,274,928 | 6/1981 | Cunningham | 204/98 |

FOREIGN PATENT DOCUMENTS

| | | | |
|---|---|---|---|
| 1336225 | 11/1973 | United Kingdom | 204/252 |

*Primary Examiner*—P. L. Andrews

*Attorney, Agent, or Firm*—James F. Tao; William G. Gosz

[57] ABSTRACT

A foraminous protective cathode for diaphragm-type electrolytic cells having a steel cathode and polymeric microporous separator reduces or eliminates separator plugging thereby increasing useful life-expectancy of the separator. The protective cathode positioned between the primary steel cathode and separator has an electroconductive metallic surface of nickel, cobalt, copper, chromium, noble metals, noble metal oxides or mixtures thereof.

19 Claims, No Drawings

METHOD OF INCREASING USEFUL LIFE EXPECTANCY OF MICROPOROUS SEPARATORS

BACKGROUND OF THE INVENTION

The present invention relates generally to improved diaphragm-type electrolytic cells having dimensionally stable metal anodes, foraminous steel cathodes and asbestos-free, polymeric microporous separators. The asbestos-free diaphragm cells of the subject invention are suitably used as chlor-alkali cells and other liquid-liquid processing apparatuses like fuel cells, osmotic cells, diffusional cells, and the like. More particularly, the invention disclosed and claimed herein is concerned with more efficient operating electrolytic cells wherein a polymeric microporous separator is in supportive contact with an electroconductive, protective foraminous cathode, said cathode being positioned between the separator and the cell's steel cathode. The iron-free electroconductive surface of the protective cathode eliminates, at least partially, plugging and loss of porosity of the separator. Without the protective cathode of the present invention, soluble corrosion products from the primary steel cathode developing during cell shutdown enter the separator to form insoluble deposits. During cell start-up the deposit build-up adversely affects cell performance, power consumption and product purity. Furthermore, because the iron oxide deposits are not easily removed the life expectancy of an affected microporous separator is severely shortened.

Diaphragm cells have long been used for the manufacture of chlorine and caustic soda. In such cells, anolyte and catholyte liquors have been previously separated by a diaphragm of deposited asbestos fibers, usually on a steel mesh cathode structure. In recent years, however, such diaphragms in some instances have been replaced by ion-permeable membranes or porous separators. Of the porous separators, those which are microporous and made, for example, from polytetrafluoroethylene (PTFE) are gaining increased favor, primarily for reasons of environmental safety, lower electrical power consumption and overall lower cell maintenance costs.

Because polymeric microporous separators are usually made in the form of sheets and not deposited onto a cell cathode like an asbestos diaphragm various methods have been proposed for cell retrofitting. One satisfactory method is disclosed in U.S. Pat. No. 4,283,264, which teaches a porous PTFE material retrofitted onto a chlor-alkali cell cathode wherein a plurality of open-ended tubular panels of a height greater than the cell cathode are equipped with polymeric flanges. The anode compartments of the cell are sealed off from the cathode compartment by bonding halves of two adjacent separator tubes. U.S. Pat. No. 4,076,571 teaches another method whereby separator envelopes are formed by heat sealing edges together; slipped over an electrode followed by closing the envelopes with clamping members.

Regardless of the method employed in the installation of polymeric separators, greater narrowing of the anode-cathode gap tolerances and cell geometry invariably requires separator panels to be in direct contact with the active surfaces of the cathode. As a result of this direct contact between polymeric separator and steel cathode, current blockage takes place and corrosion of the cathode occurs at points of contact. During periods of cell shut-down, soluble iron oxide corrosion products from the steel cathode collect in the separator pores forming insoluble iron oxide deposits after cell start-up which in-turn migrate to the outer surface of the separator. The deposits have the negative effect of causing at least a partial plugging of the separator and loss of porosity, inducing elevated voltages and higher power consumption. In addition, the separator deposits create active cathode sites where hydrogen can be evolved in the anolyte contaminating the halogen gas being formed. A build-up of deposits will also create excess anolyte head heights requiring early replacement of the separator.

Heretofore, various devices, including cell diaphragm additives and coatings have been suggested as means for improving cell performance. For example, British patent specification No. 1,336,225 and U.S. Pat. No. 3,989,615 and in particular the former disclose a chlor-alkali cell comprising a fibrous diaphragm and a supporting net disposed between the diaphragm and cathode. The supporting net is fabricated from stainless steel, titanium or iron. However, titanium metal is subject to hydrogen embrittlement and will dissolve in the catholyte while iron and stainless steel are capable of forming insoluble metal oxides in the diaphragm thereby reducing separator porosity. U.S. Pat. Nos. 2,944,956 and 3,344,053 and in particular the latter suggests placement of a secondary screen adjacent to the diaphragm facing the cathode. However, the screen has an outer polymeric coating rendering it electrically non-conductive and hydrophobic to cell electrolyte. U.S. Pat. No. 4,165,271 describes a diaphragm comprised of a support fabric, including PTFE which is impregnated with a gel-forming silica material and a non-continuous electroconductive surface coating of nickel, nickel alloys, platinum group metals and their alloys. The application of non-continuous coatings on separator surfaces have shorter life expectancies, especially during recurring cell shut-down periods. Accordingly, there is a need for an improved secondary cathode to be used in conjunction with a polymeric microporous separator equipped electrolytic cell.

It has now been discovered that an independent foraminous protective cathode placed as a barrier to direct contact between the primary steel cathode and a polymeric microporous separator of an electrolytic cell will greatly extend the useful life expectancy of the separator. The protective cathode, in the form of a mesh or screen has a stable, continuous electroconductive metallic surface which is also hydrophillic to cell contents.

Accordingly, it is a principal object of the present invention to provide a method for extending the useful life expectancy of asbestos-free, microporous separators used in electrolytic cells.

A further object of the immediate invention is a solution to the problem of corrosion products from the primary steel cathode of an electrolytic cell depositing and plugging microporous separators as a result of cell shutdown.

A still further object of the present invention is the fabrication of a protective cathode screen having an electroconductive metallic surface which is more stable than steel to the corrosive environment of a chlor-alkali cell.

These and other objects, features and advantages will become apparent to those skilled in the art after a reading of the following more detailed description.

EMBODIMENTS OF THE INVENTION

Broadly, the present invention relates to improved electrolytic cells comprising a plurality of dimensionally stable anodes and steel cathodes in alternating arrangement and separated by an asbestos-free, polymeric microporous separator. The electrolytic cell includes a protective foraminous cathode positioned between the steel cathode and microporous separator. The protective cathode has a metallic surface such that it is capable of conducting current through the cell from the anode to cell electrolyte to the primary steel cathode with minimal IR drop. The electroconductive metallic surface of the protective cathode is comprised of either nickel, cobalt, copper, chromium, noble metals such as platinum, ruthenium, rhodium, osmium and iridium, including oxides of such noble metals. The present invention also contemplates mixtures of the above metals which is inclusive of metal alloys. Suitable alloys include those which are capable of withstanding the corrosive environment of a chlor-alkali cell, such as copper-nickel alloys like Monel TM and alloys containing copper and cobalt. The preferred metals, however, are nickel, nickel alloys and copper because of low cost, availability and satisfactory life expectancy.

The protective cathode which is in the form of a porous wire/mesh screen may be constructed exclusively of the above metals or mixtures. That is to say, instead of plating a steel screen with nickel or copper, the protective cathode may be fabricated, for example, from solid nickel or copper wire or mesh. However, steel or copper screening, for example, may be used satisfactorily as a substrate for a surface coating of the foregoing electroconductive metallic coatings.

Regardless whether the protective cathode is in the form of a porous screen plated with one or more of the above metallic coatings, or alternatively, fabricated from solid, uncoated material of the same, it is preferred that the porosity of the mesh approximate that of the primary steel cathode of the cell. There are no specific restrictions as to the style of the screen openings of the protective cathode. However, the openings should not be so large as to permit the polymeric separator during cell operation to penetrate the openings and make physical contact with the primary steel cathode. Should the separator make contact with the steel cathode either through openings in the protective cathode which are excessively large, or because of geometrical design of the mesh, iron oxide corrosion products will develop at points of contact during cell shutdown and enter the separator to form deleterious insoluble deposits during cell start-up. The buildup of deposits in a relatively short time period will necessitate premature cell renewal and costly downtime.

Plating the protective cathode according to the present invention involves well-known methods and materials. With the exception of noble metal oxides, the metallic coatings are preferably applied to a foraminous substrate using standard electroplating techniques. Other well-known methods may also be used, including metal spraying, plasma spraying, vacuum depositing, electroless plating, thermal coating and the like. Whichever method is employed the plating process should preferably provide a continuous, substantially non-porous surface having a thickness in the range of about 0.1 to 10 mils, and preferably 0.6 to 5 mils. The total thickness of the protective cathode preferably should not exceed 1 mm, since greater thicknesses will result in a voltage penalty due to IR drop.

As previously indicated, electroplating a foraminous substrate, such as a steel screen with nickel metal provides an economical and reliable protective cathode. Nickel may be plated onto such a screen using a standard Watts bath with plating solutions comprising, for example, nickel sulfate ($NiSO_4.6H_2O$) 240–340 gpl; nickel chloride ($NiCl_2.6H_2O$); 30–60 gpl and boric acid ($H_3BO_3$) 30–40 gpl. The plating process may be carried out at a temperature range of about 50°–60° C., at a pH of 3 to 5 and a current density of 0.25 to 0.5 amps/in$^2$. Copper may also be electroplated on steel mesh screen using "High-Efficiency" high-speed cyanide copper plating type processes. Details, including materials and methods for electroplating nickel, copper, cobalt, chromium, noble metals and their alloys are described in the publication *Modern Electroplating,* edited by Frederick A. Lowenheim, Pub. John Wiley & Sons Inc., 3rd. Edition 1977, said publication is incorporated-by-reference herein.

Coatings of noble metal oxides such as platinum and ruthenium may be conveniently applied to a foraminous screen by known methods such as electrophoresis; by spraying the oxide or mixture of oxides onto the screen at elevated temperature and/or pressure; by brushing or painting the screen with a dispersion of the oxide or mixture of oxides in an unstable carrier followed by firing; or by contacting a grounded screen with electrostatically charged oxide or mixture of oxides at room temperature following by baking. Generally speaking, the application of the oxide or mixture of oxides directly to the substrate will be effected under oxidizing conditions. The noble metal oxides or mixtures thereof can also be applied directly to the foraminous screen by immersing one or two of such screens connected to a source of current in a solution of a noble metal salt or a solution containing a mixture of such salts and passing a direct or alternating current or combination of the two through the immersed electrodes for a period of time. The noble metal oxide or mixtures thereof can also be formed on the foraminous screen in-situ for one or more of platinum, iridium, rhodium, ruthenium and osmium, for example, by heating, chemical reaction or electrochemical reaction. Oxidation of the same can be achieved by heating in air, for example, in the case of ruthenium at atmospheric pressure and at a temperature of from 300°–500° C. Iridium and rhodium can be heated in an oxygen containing atmosphere at a temperature of from 600° C. and higher and at a partial pressure of oxygen of at least 300 atmospheres.

Because the protective cathode is a thin, light-weight screen, it is flexible enough so that it can be bent by any convenient means to conform with cell geometry. The only requirement be that it fit smoothly across the active surfaces of the primary cathode. The separator will be in supportive contact with the protective cathode. The latter being in most instances in electrical contact with the cell's primary cathodic surfaces. A close, tight fit between the protective cathode and the primary steel cathode will also help to avoid possible tearing or puncturing of the separator during cell assembly. Because of the electroconductive properties of the protective cathode, when butted against the primary steel cathode making more than minimal contact it is capable of performing as a secondary cathode in the production of hydrogen and caustic. Correspondingly, the cathode may also make minimal contact with the primary steel cathode such as to provide only cathodic protection. Under such circumstances, little or no hydrogen will be produced at the protective cathode.

As previously indicated, the protective cathode is disposed between and in juxtaposition to the primary cathode and polymeric separator. The cathode may be installed as a substantially planar screen parallel to the active surfaces of the primary cathode. This can be conveniently achieved, for example, by bending the protective cathode into a substantially U-shaped configuration. The U-shaped screen may be installed by suspending from the top of the primary cathode such that each leg of the U-shaped screen is draped over adjacent active surfaces of the cathode.

The polymeric separators referred to herein relate to asbestos-free diaphragms which are microporous and of a fluorine-containing polymer. While other fluorocarbon polymers may be used, polytetrafluoroethylene (PTFE) has been found to have the most desired chemical inertness for purposes of the present invention. Suitable fluorocarbon polymers may include PTFE, polytrifluoroethylene, polyvinyl fluoride, polyvinylidene fluoride, polychlorotrifluoroethylene, polyfluoroethylenepropylene, polyperfluoroalkoxyethylene and copolymers thereof.

Asbestos-free microporous separators can be made by any number of known methods, including methods known as additive leach, dispersion casting, slip forming and the like. U.S. Pat. No. 3,556,161, issued Jan. 19, 1971, relates to PTFE sheet materials formed by the "slip forming" process, comprising mixing PTFE powder with a liquid, such as kerosene, and then sequentially working the resultant composition by the application of concurrent compressive stress and shear stress, the sequence of operations being directed so that the shear stress components are distributed substantially biaxially, resulting in planar orientation in the resulting article. U.S. Pat. Nos. 4,170,540 and 4,289,600 each relate to additive leach type processes whereby perfluoroalkylene polymer, a particulate pore-forming agent, e.g. calcium carbonate, and a lubricant, preferably a non-ionic fluorinated surface active agent are mixed as a first step to form a doughy material. The separator sheet is formed by repeated milling steps and dried. The sheets are subsequently sintered, cooled and the pore-former leached by acid bath leaving an internal network of pores in the separator. Because of the hydrophobic properties of PTFE type separators, they must be made wettable to cell contents by further treatment. Once such satisfactory method is described in U.S. Pat. No. 4,252,878.

It is contemplated that the described foraminous protective cathode and microporous separator be used in combination and preferably in electrolytic cells utilized for the manufacture of chlorine and caustic soda. Although such cells are of various types, in all of them it is important that the anolyte be separated from the catholyte and that slight, limited and preferably controlled movement of anolyte into the catholyte be maintained. The protective cathode, as described, may be used in such cells and it will be apparent to those skilled in the art how to modify the structure, manufacturing methods and uses of the present invention so as to make it applicable to different types of chlorine-caustic and other electrolytic cells. Among the chlor-alkali cells are the Hooker type diaphragm cells, e.g. the Hooker type H-4 cells and the Diamond-type cells, e.g. the DS-85 cells, in both of which the present protective cathode and microporous separator combination may be used in replacement of asbestos diaphragms. Modern cells of this type are also equipped with foraminous steel cathodes and dimensionally stable metal anodes. Such anodes preferably have a valve metal substrate, e.g. titanium, with a coating thereon of a precious metal, precious metal oxide, or other electro-catylytically active corrosion resistant material, e.g. ruthenium oxide, platinum or a mixture of noble and non-noble metal oxides, such as ruthenium and titanium oxides.

The following specific examples demonstrate the process of the instant invention, however, it is to be understood that these examples are for illustrative purposes only, and do not purport to be wholly definitive as to conditions and scope.

EXAMPLE I

A bench scale laboratory cell having a glass housing was set up with a dimensionally stable metal anode and steel cathode. The anode which had a diameter of 2.71 inches was comprised of a foraminous titanium metal base having a thin thermal coating of ruthenium and titanium oxides. The cathode consisted of a steel screen having an approximate diameter of 3 inches. An asbestos-free microporous separator having a diameter of 3⅛ inches was mounted in the cell, so that it was in direct contact with the steel cathode.

The separator which was fabricated from polytetrafluoroethylene was cut from a larger sheet of the material made by the additive leach method described in U.S. Pat. No. 4,289,600 using the steps of blending the polytetrafluoroethylene, calcium carbonate pore-former and a lubricant consisting of Zonyl® FSN fluorosurfactant by E. I. DuPont; milling the material on a two-roll rubber mill; dried; sintered and the pore-former leached from the separator in hydrochloric acid. The separator was washed in water and dried. In order to render the polytetrafluorethylene separator wettable to the cell electrolyte, it was treated in a solution of Zonyl FSN surfactant under vacuum and dried using the method of U.S. Pat. No. 4,252,878.

The glass cell housing was sealed by clamping the anolyte and catholyte compartments together using rubber gaskets. Heated water was initially fed to the cell in order to activate in-situ the wettability properties of the separator, followed by filling the anolyte compartment of the cell with aqueous brine solution containing more than 290 grams/liter sodium chloride. A DC power source was connected to the cell's electrodes for start-up. The cell was operated at a current density of 8.61 amps or 1.5 amps/sq. inch which produced a catholyte containing between 120 and 160 grams/liter caustic soda at a cell voltage of about 3.2 to 3.4 volts. The cell operated continuously for 72 days when a sample of chlorine gas from the anolyte compartment was analyzed by gas chromatograph and found to contain less than 0.1% hydrogen.

On day 91 there was a power shutdown to the cell for a period of 3 hours. During that period of time, brine feed to the cell continued. Massive corrosion of the steel cathode was observed. Power to the cell was turned on at the conclusion of the 3-hour interval and samples of chlorine gas were analyzed on days 93, 95 and 113, and found to have increased hydrogen levels, namely 0.56%, 0.75% and 0.68%, respectively. Power shutdown on day 113 was repeated for an interval of 3 hours and the cathode was allowed to corrode. At the conclusion of the 3-hour interval, power to the cell was turned on and on day 114 the chlorine gas from the anolyte compartment was again analyzed and found to contain 1.5% hydrogen.

The foregoing results indicate that corrosion of the cathode during periods of cell shutdown adversely effects anolyte purity when insoluble iron oxide deposits form in the pores of a microporous separator.

EXAMPLE II

Part A

A screen fabricated from 24 guage cold rolled steel was cut to a circular shape with a diameter of 3½ inches. The screen had ⅛ inch square holes with distances between centers being 5/32 inch. A Watts bath solution was prepared in order to plate the steel screen with a continuous, pore-free coating of nickel metal. The plating bath solution contained 300 grams/liter nickel sulfate hexahydrates; 45 grams/liter nickel chloride hexahydrate; 37 grams/liter boric acid and 0.3 grams/liter of a dodecylsodium sulfate surfactant. Nickel carbonate was added to the mixture to raise the pH to about 4.5, heated to about 40° C. and filtered in order to remove excess carbonate. The pH of the bath was adjusted to 3 by the addition of sulfuric acid.

A 3-liter glass beaker was filled with the above Watts plating formulation. A nickel anode was placed in the bath along with the cathode screen to be plated. The temperature of the bath was adjusted to 53° C. Plating was carried out in two stages; the first was conducted at a current density of 0.5 amps/inch$^2$ for 10 minutes and the second at 0.25 amps/inch$^2$ for 40 minutes. The screen had a continuous, virtually pore-free coating of nickel metal which was approximately 1.3 mils thick.

Part B

A glass laboratory cell of the type described in Example I was set up with a new sample of PTFE microporous separator. The cell also included a dimensionally stable metal anode and steel cathode of the type previously described. The nickel plated steel screen prepared according to Part A above mounted between gaskets was installed between the steel cathode and microporous separator. One side of the nickel plated screen was butted against the steel cathode and the other against the microporous separator. The cell was sealed and prepared for start-up. The mode of operation of the cell corresponded to that described in Example 1. After 8 consecutive days of operation a sample of the chlorine gas from the anolyte compartment was taken and analyzed by gas chromatograph and found to contain less than 0.1% hydrogen. The cell was shut down for 3 hours on each of days 8 and 13. Corrosion of the steel cathode was drastically reduced over that of Example I, as judged by visual appearance in the catholyte compartment. After cell start-up anolyte gas samples were taken and analyzed again on each of days 9 and 14. The samples contained less than 0.1% hydrogen.

The above Example illustrates that the nickel plated protective cathode prevents corrosion of the primary steel cathode and deposition of insoluble oxides in the separator during cell shutdown, as indicated by the very low levels of hydrogen in the chlorine gas.

While the invention has been described in conjunction with specific examples thereof, this is illustrative only. Accordingly, many alternatives, modifications and variations will be apparent to those skilled in the art in light of the foregoing description and it is therefore intended to embrace such alternatives, modifications and variations that would fall within the spirit and broad scope of the appended claims.

What is claimed is:

1. A method of increasing the useful life expectancy of a polymeric microporous separator in an electrolytic cell having alternating dimensionally stable metal anodes and foraminous steel cathodes, which comprises placement of a foraminous protective cathode between the steel cathode and microporous separator, said protective cathode having an electroconductive metallic surface made from a material selected from the group consisting of nickel, cobalt, copper, chromium, noble metals, noble metal oxides and mixtures thereof.

2. A method of claim 1 wherein the microporous separator is comprised of a perfluoroalkylene polymer.

3. The method of claim 2 wherein the perfluoroalkylene polymeric separator is comprised of polytetrafluoroethylene.

4. The method of claim 3 wherein the electroconductive metallic surface of the protective cathode is comprised of a metal selected from nickel, nickel alloys and copper.

5. The method of claim 4 wherein the protective cathode is fabricated from a steel screen plated with nickel metal.

6. The method of claim 5 wherein the nickel plating is in the form of a continuous, substantially non-porous coating.

7. The method of claim 4 wherein the protective cathode is an electrically conductive nickel screen.

8. The method of claim 4 wherein the protective cathode is a copper screen.

9. An electrolytic cell for the production of chlorine, alkali metal hydroxide and hydrogen which comprises a plurality of dimensionally stable metal anodes and foraminous steel cathodes in alternating arrangement separated by an asbestos-free polymeric microporous separator, said cell including a foraminous protective cathode in juxtaposition with the steel cathodes and microporous separator, the protective cathode having an electro-conductive metallic surface made from a material selected from the group consisting of nickel, cobalt, copper, chromium, noble metals, noble metal oxides and mixtures thereof.

10. The electrolytic cell of claim 9 wherein the electro-conductive metallic surface of the protective cathode is comprised of nickel, nickel alloys or copper.

11. The electrolytic cell of claim 10 wherein the protective cathode is a steel screen plated with nickel metal.

12. The electrolytic cell of claim 11 wherein the nickel plating is in the form of a continuous, substantially non-porous coating.

13. The electrolytic cell of claim 10 wherein the protective cathode is an electrically conductive nickel screen.

14. A method for the electrolytic production of chlorine, alkali metal hydroxide and hydrogen which comprises applying a decomposition voltage to an electrolytic cell charged with an alkali metal chloride electrolyte, said cell comprising a plurality of dimensionally stable metal anodes and foraminous steel cathodes separated by a asbestos-free, polymeric microporous separator, said cell including a foraminous protective cathode in juxtaposition with the steel cathode and microporous separator, said protective cathode having an electroconductive metallic surface made from a material selected from the group consisting of nickel, cobalt, copper, chromium, noble metal, noble metal oxides and mixtures thereof.

15. The method of claim 14 wherein the microporous separator is comprised of polytetrafluoroethylene and the protective cathode has the surface of nickel or copper.

16. The method of claim 15 wherein the protective cathode comprises a steel screen plated with a continuous, substantially non-porous coating of nickel metal.

17. The method of claim 15 wherein the protective cathode is a nickel screen.

18. The method of claim 15 wherein the protective cathode is a copper screen.

19. In an electrolytic cell comprising a plurality of dimensionally stable metal anodes and foraminous steel cathodes in alternating arrangement, separated by a polymeric microporous separator, the improvement comprising an electrically conductive foraminous protective cathode in juxtaposition to the steel cathodes and microporous separator, the protective cathode having a continuous, substantially non-porous metallic surface of nickel or copper.

* * * * *